US005758532A

United States Patent [19]

Massée

[11] Patent Number: 5,758,532

[45] Date of Patent: Jun. 2, 1998

[54] METHOD AND APPARATUS FOR MAKING A PRODUCT BY SPINNING

[76] Inventor: Johan Massée, Vijfsprongweg 104, 6741 JC Lunteren, Netherlands

[21] Appl. No.: 743,660

[22] Filed: Nov. 5, 1996

[30] Foreign Application Priority Data

Nov. 17, 1995 [NL] Netherlands ..... 1001675

[51] Int. Cl.[6] ..... B21D 22/18

[52] U.S. Cl. ..... 72/83; 72/13.5; 72/81

[58] Field of Search ..... 72/81, 83, 13.5

[56] References Cited

U.S. PATENT DOCUMENTS

| | | | |
|---|---|---|---|
| 3,114,342 | 12/1963 | Sporck et al. | 72/83 |

FOREIGN PATENT DOCUMENTS

| | | | |
|---|---|---|---|
| 0125720 | 11/1984 | European Pat. Off. . | |
| 29 27 604 | 1/1981 | Germany . | |
| 60-177919 | 9/1985 | Japan . | |
| 60-240337 | 11/1985 | Japan | 72/83 |
| 1-218721 | 8/1989 | Japan | 72/83 |

OTHER PUBLICATIONS

R. Falb, "Metalldrücken –eine wirtschaftliche Alternative", *Zwf Zeitschrift Fur Wirtschaftliche Fertigung*, Jan. 1, 1986, pp. 54–58.

*Primary Examiner*—Lowell A. Larson

*Attorney, Agent, or Firm*—Westman, Champlin & Kelly, P.A.; S. Koehler

[57] ABSTRACT

Method and apparatus for spinning a product, wherein a metal plate which may be preshaped or not, is deformed on a rotating chuck by a forming roller into a hollow product with a wall thickness. The shape of the chuck is determined and is stored in a memory of a control unit as a series of successive points. The control unit moves the forming roller according to a path corresponding with the shape of the chuck. This path is determined by the stored shape of the chuck with a desired wall thickness of the product added thereto. The metal plate is deformed by moving the forming roller according to the thus determined path. In each point of the stored shape of the chuck, the control unit determines a tangent line of the chuck shape at the location of this point and adds the desired wall thickness to the chuck shape at the location of this point according to a line perpendicular to the tangent line to calculate the path of the forming roller.

9 Claims, 3 Drawing Sheets

METHOD AND APPARATUS FOR MAKING A PRODUCT BY SPINNING

BACKGROUND OF THE INVENTION

1. Field of the Invention

The present invention relates to a method for spinning a product, wherein a metal plate which may be preshaped or not, is deformed on a rotating chuck by a forming roller into a hollow product with a wall thickness. The the shape of the chuck is determined and is stored in a memory of a control unit as a series of successive points; the the control unit moves the forming roller according to a path corresponding with the shape of the chuck, said path being determined by the stored shape of the chuck with a desired wall thickness of the product added thereto, whereafter the metal plate is deformed by moving the forming roller according to the thus determined path.

2. Description of the Related Art

In a known method of this type which is generally indicated by projection spinning, the path of the forming roller is determined by incorporating a calculated wall thickness $S_1$ of the product in the chuck shape. The wall thickness is calculated according to the equation:

$$S_1=S_0\times\sin\alpha/\sin\beta$$

wherein:

$S_1$=wall thickness of product perpendicular to the surface $S_0$=thickness of flat metal plate $\alpha$=angle of chuck shape with respect to the center line of the same at the point where the forming roller engages the metal plate $\beta$=angle of a preshaped metal plate part with respect to the center line of the product.

In this known method the calculated wall thickness is converted into a movement of the upper slide and, if necessary, a movement of the lower slide of the spinning lathe. The forming roller is actually moved away from the chuck along a distance dependent on the calculated wall thickness $S_1$. As long as there is a relatively simple shape of the chuck with straight contour lines only, this known method may provide a reasonable result. However, with more fanciful contour shapes, very long adjusting times for the spinning lathe occur and nevertheless satisfying results are not obtained.

SUMMARY OF THE INVENTION

The invention aims to provide a method of the above-mentioned type, wherein not only the calculated wall thickness $S_1$ according to the above-mentioned equation is incorporated but also any other desired wall thickness can be incorporated in the path of the forming roller in a simple manner. The method allows the adjusting time of the spinning lathe to be kept to a minimum while products of a high quality are manufactured.

According to the method of the invention the control unit determines a tangent line of the chuck shape at each point of the stored shape of the chuck and adds the desired chuck shape to the wall thickness at the location of said each point according to a line perpendicular to said tangent line in order to calculate the path of the forming roller.

In this manner it is obtained that the inclination of the tangent line of the chuck shape is accurately known at each point and that the desired wall thickness can be added to the chuck shape in accordance with the line perpendicular to this tangent line in an accurate manner in any point, so that the path of the forming roller to be followed for spinning the desired product, can be computed with high accuracy. The computation can be made only once by the control unit, whereafter the spinning of the product can occur in a usual manner. As with the use of the method according to the invention the computed wall thickness $S_1$ is added with high accuracy, and projection spinning occurs with high accuracy, which will benefit the surface quality of the final product, whereas the adjusting time remains at a minimum since a computation with need to be made only once.

The invention further provides an apparatus for applying the above-described method, said apparatus of the invention comprising a clamping device for a chuck, a forming roller, a control unit for moving the forming roller according to a desired path, means for storing the shape of the chuck in a memory, for example by tracing the chuck with the forming roller. The control unit is adapted to determine the path of the forming roller from the stored shape of the chuck with a desired wall thickness added thereto and to control the forming roller in accordance with the thus determined path, wherein the control unit is adapted to determine a tangent line of the chuck shape at each point of said chuck shape and to add the desired wall thickness according to a line perpendicular to said tangent line to the chuck shape at this point.

The invention will be further explained by reference to the drawings in which an embodiment of the method and apparatus according to the invention are very schematically shown.

DESCRIPTION OF THE PREFERRED EMBODIMENT

Figure 1:
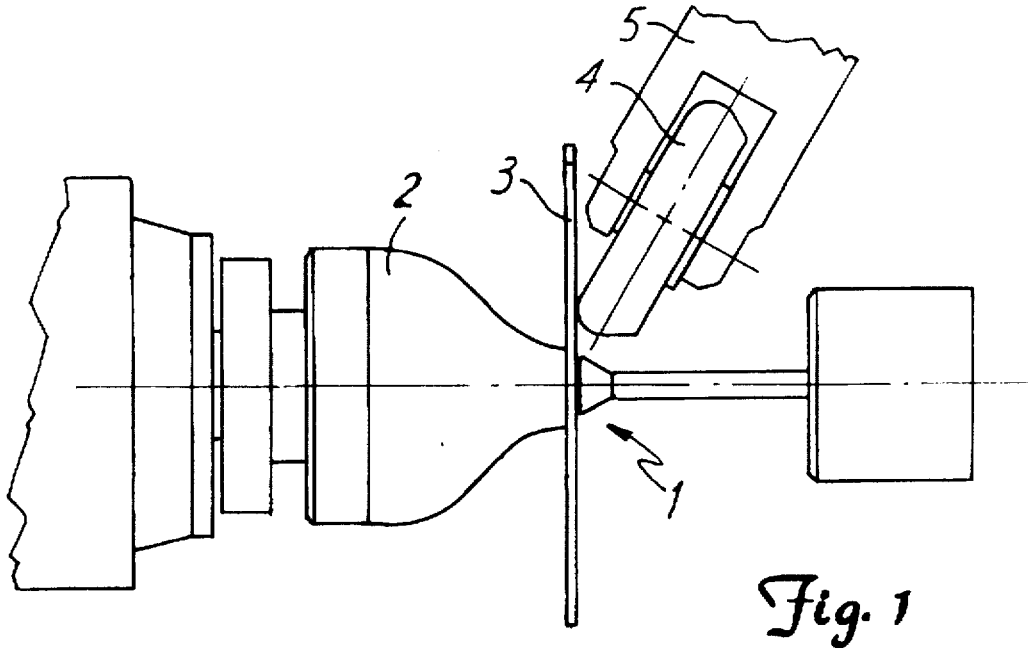
FIG. 1 is a schematic plan view of part of an embodiment of the apparatus according to the invention.

FIG. 1 schematically shows a plan view of a portion of an apparatus for manufacturing a product by spinning a metal plate, said apparatus usually being mentioned as a spinning lathe. The spinning lathe comprises a rotatably drivable clamping device 1, in which a chuck 2 is provided. A disc-like metal plate 3, which in this case is flat, is clamped against the chuck 2 in a conventional manner. The metal plate 3 has to be deformed into a desired product on the chuck 2 by means of a forming roller 4 which is rotatably borne in a fork-shaped holder 5. For this purpose, the forming roller 4 should follow a predetermined path of movement and therefor the holder 5 is supported by a movable upper slide mounted on a movable lower slide. As these parts are not of essential importance for the present invention, reference is made to the earlier Dutch patent application 1000851 of the same applicant and to EP-A-0 125 720, the contents of which are incorporated herein by reference thereto.

Figure 2:
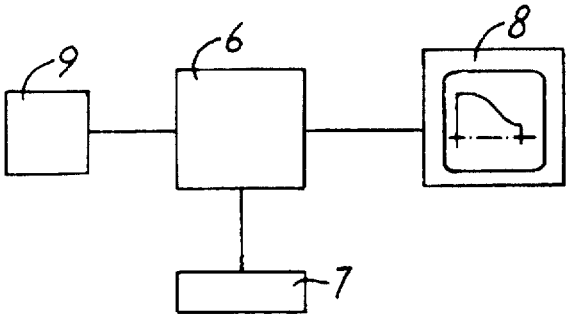
FIG. 2 a block diagram of a part of the apparatus of FIG. 1.

FIG. 2 shows in a very schematical manner the control part of the described apparatus, comprising a control unit 6, an input means 7 for example, a keyboard, a display 8 and a memory 9.

For spinning the metal plate 3 on the chuck 2 in the production phase, the shape of the chuck 2 is stored in the memory 9 of the apparatus. This can be done using various techniques, for example by input through the keyboard 7 of the shape of the chuck 2 as co-ordinates with respect to the center line. It is also possible to trace the chuck 2 by moving the forming roller 4 along the chuck 2 with force control.

When the shape of the chuck 2 is stored in the memory 9, for example as X and Y co-ordinates, the path of the forming roller 4 along the chuck 2 can be displayed graphically on the display 8. In case of manufacturing a product with a desired wall thickness $S_1$, the path to be followed by the forming roller 4, is determined by the stored shape of the chuck 2 and the thickness $S_0$ of the metal plate 3 according to the equation:

$$S_1=S_0\times\sin\alpha$$

in which:

$S_1$=wall thickness of product perpendicular to the surface $S_0$=thickness of flat metal plate $\alpha$=angle of chuck shape with respect to the center line thereof at the location where the forming roller engages the metal plate, wherein the computed wall thickness $S_1$ is added to the chuck shape at each point, as will be explained further hereinafter.

When the wall thickness is computed in this manner, it follows that the wall thickness is greater as the angle $\alpha$ becomes greater and thereby as the original flat metal plate 3 has to be deformed less. This corresponds with a true projection of the volume of the metal plate 3 on the contour of the chuck 2, as shown by way of example for a simple chuck shape in FIG. 2. When the path of the forming roller 4 starting from the shape of the chuck 2 is determined by adding the computed wall thickness $S_1$ thereto, the transport of material in axial direction of the chuck is therefore minimized, which increases to the quality of the surface of the product obtained.

The thickness $S_0$ of the metal plate 3 can be input by means of the keyboard 7. Thereafter the control unit 6 computes the path to be followed by the forming roller 4 by means of the co-ordinates of the contour or shape of the chuck 2 and the movement of the forming roller 4 is controlled according to the computed path. It is noted that by means of the above-mentioned equation it is also possible to compute the required thickness $S_0$ of the metal plate 3 starting from a desired wall thickness $S_1$ of the product.

Figure 3:
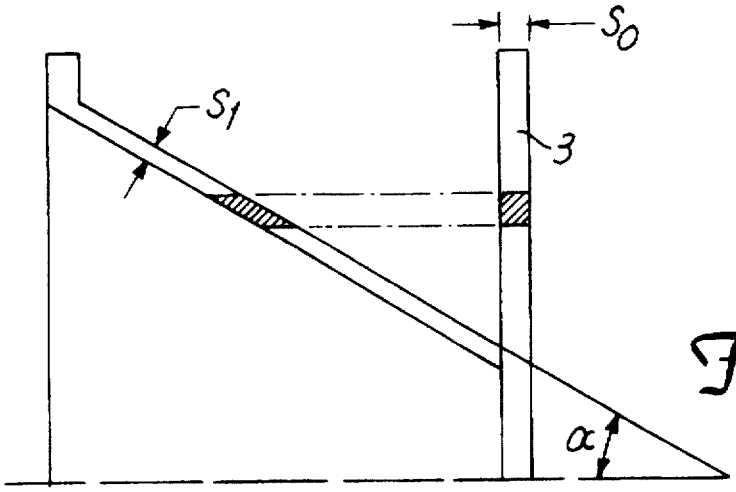
FIG. 3 shows a simple projection of a flat metal plate on a chuck.
Figure 4:
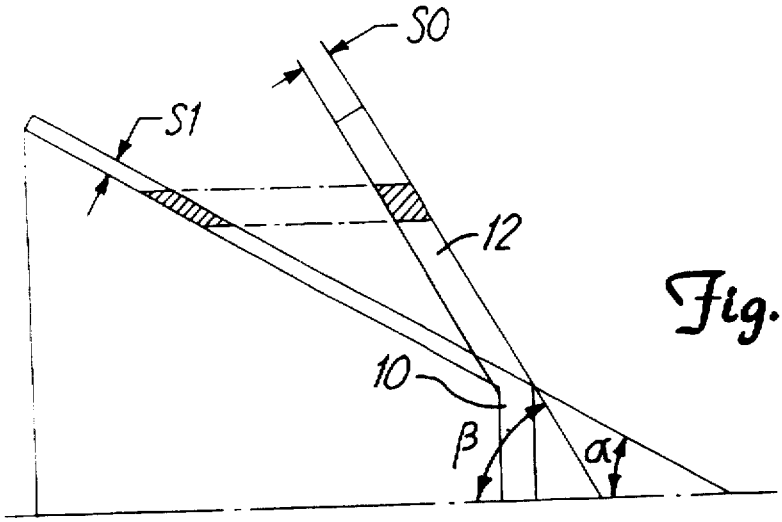
FIGS. 4 and 5 show alternative preshaped metal plates and their projection on the chuck of FIG. 3.
Figure 5:
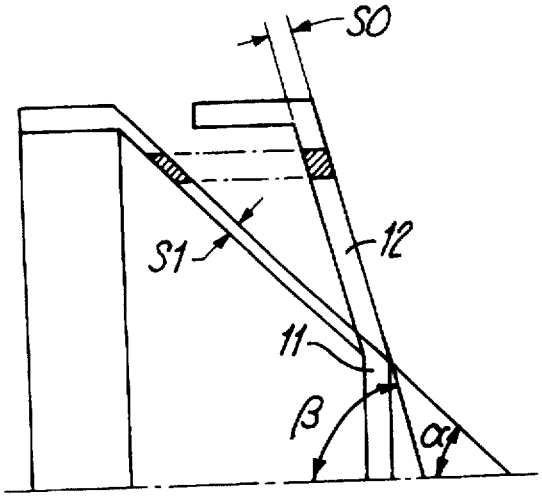

For spinning a desired product from a metal plate, it is also possible to start with a metal plate which is preshaped by pressing or the like. As example two possible simple preshaped metal plates 10 and 11 are shown in FIGS. 3 and 4 in the same manner as in FIG. 2. Starting from such a preshaped metal plate the angle $\beta$ of a preshaped metal plate part 12 with the center line of the product to be made or the chuck 2, respectively should be taken into account. The equation for computing the wall thickness $S_1$ is in this case:

$$S_1=S_0\times\sin\alpha/\sin\beta$$

For a flat metal plate $\beta$=90°, this equation applies generally for determining the path of the forming roller in the manner described above.

Figure 6:
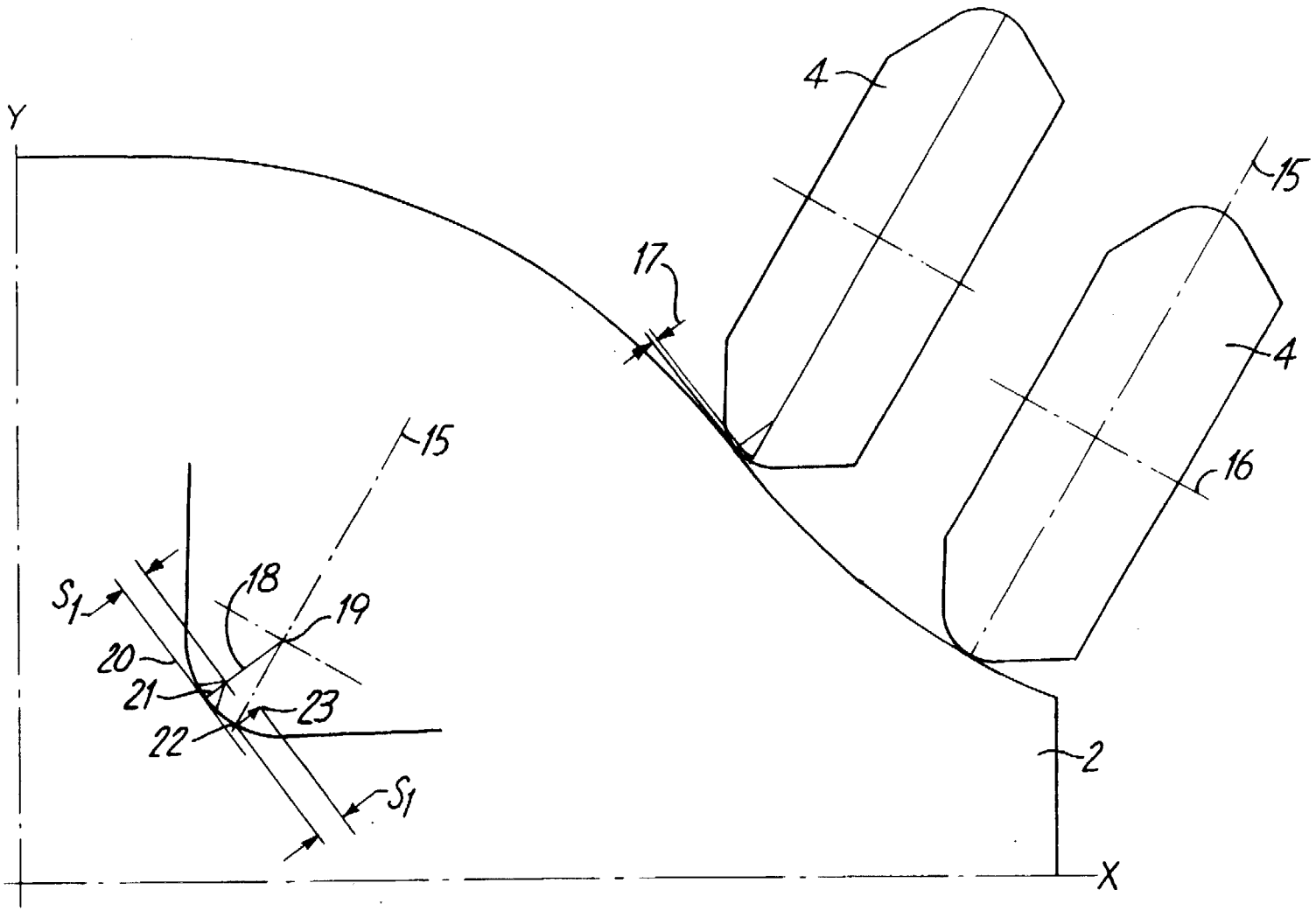
FIG. 6 schematically shows the chuck shape of FIG. 1, wherein at two locations along the chuck shape the forming roller is indicated and the principle of the computation of the path of the forming roller made according to the method of the invention is shown in a detail at a larger scale.

With the simple chuck shapes of FIGS. 2–4 it would be possible to determine the angle $\alpha$ or $\beta$, respectively, by measuring. With a more complicated chuck shape, an example of which is shown in FIGS. 1 and 6, this is however not possible anymore. According to the invention, the path of the forming roller 4 can nevertheless be determined in a very accurate manner by the control unit 6 from the chuck shape stored in the memory 9. FIG. 6 shows the forming roller 4 cooperating with the chuck 2 at two locations with respect to the chuck 2. The metal plate 6 is not shown in FIG. 6. The directions in which the upper and lower slides, respectively, are movable, are shown by dashed lines 15 and 16, respectively. The control unit 6 measures the movement of the forming roller 4 according to the line 15 and assumes therefore that the forming roller 4 contacts the chuck 2 at the point where line 15 intersects the outer circumference of the forming roller 4. Due to the radius of the forming roller 4 the shape of the chuck 2 is actually not determined exactly in this manner, as is shown in FIG. 6 at 17. By adding a certain wall thickness to the traced chuck shape, the control unit 6 can calculate the path of the forming roller 4 from the intersection of line 15 with the circumference of the forming roller 4.

When the shape of the chuck 2 is stored in the memory 9 by tracing, the control unit 6 can compute the actual chuck shape at each point of the traced chuck shape by projecting the known roller radius 18 of the forming roller 4 from the also known center 19 of the forming roller 4 on the traced chuck shape, and computing the greatest distance between the traced chuck shape and the projected circumference of the forming roller 4. The point of the projected circumference of the forming roller 4 where the greatest distance occurs, is the point where the forming roller 4 is actually contacting the chuck 2 and is therefore a point of the actual chuck shape. The series of points computed in this manner, determine the actual chuck shape. Then the control unit 6 can determine at each point of the actual chuck shape a tangent line 20 of the chuck shape at the location of the corresponding point. To this end a straight line through two points of the actual chuck shape lying at both sides of the corresponding point is taken as tangent line 20 of the chuck shape. The angle $\alpha$ at each point of the actual chuck shape follows very accurately from the inclination of this tangent line 20, said angle $\alpha$ being used to compute the wall thickness $S_1$ for projection forming. The wall thickness $S_1$ is added to the corresponding point of the traced chuck shape according to the perpendicular line 21 on the tangent line 20 to compute the path of the forming roller, as shown in FIG. 6 by way of example for the point 22 of the scanned chuck shape. In this manner, the point 23 is computed to be on the path to be followed by the forming roller 4 during deformation of the metal plate into the desired product. With the application of the method according to the invention it is thereby possible to carry out projection forming with high accuracy, whereas the adjusting time remains low, comprising the time required for scanning the chuck shape and then computing the path of the forming roller.

According to the invention it is also possible to add a constant distance to the traced chuck shape, so that the forming roller 4 will be moved along the chuck 2 with a constant gap. Further it is possible to use a combination of the computed wall thickness $S_1$ and a constant gap in a product, whereas a wall thickness of the product varying in an other manner can also be obtained.

When using a preshaped metal plate with a more complicated shape it is also possible to trace the metal plate with the forming roller 4, so that this shape is accurately known and the angle $\beta$ can be derived from the traced shape.

The computed path of the forming roller 4 is shown on the display 8 and, if desired, a change can be made in the path of the forming roller 4 along the chuck 2, so that a product with each desired outer contour can be manufactured.

The invention is not restricted to the above-described embodiments which can be varied in a number of ways within the scope of the claims.

I claim:

1. A method for forming a hollow product with a desired wall thickness on a rotating chuck using a forming roller, the method comprising the steps of:

storing in a memory of a control unit a series of successive points representative of a shape of the chuck;

determining a tangent line of the chuck shape at each point;

calculating a path by adding the desired wall thickness to each point according to a line perpendicular to the associated tangent line; and moving the forming roller according to the path.

2. The method of claim 1 wherein the step of storing the shape of the chuck includes:

tracing the chuck with the forming roller; and determining each point in the series of successive points by projecting a radius of the forming roller on the traced chuck shape at each point of the traced chuck shape and finding the greatest distance between a surface of the forming roller corresponding to the projecting radius and the traced chuck shape, wherein each point of the chuck shape is the greater distance between the surface of the forming roller corresponding to the projecting radius and the traced chuck shape.

3. The method according to claim 2 and further comprising the step of calculating the wall thickness to be added at each point, wherein the wall thickness to be added at each point is calculated according to the equation:

$$S_1=S_0\times\sin\alpha/\sin\beta$$

wherein $S_1$=wall thickness of product perpendicular to chuck surface $S_0$=thickness of a flat metal plate $\alpha$=angle of inclination of the associated tangent line of the chuck shape at the point where the forming roller engages the metal plate $\beta$=angle of a preshaped part of metal plate with respect to center line of the product.

4. The method according to claim 3 and further comprising:

providing a preshaped metal plate to be formed by the forming roller; and tracing the preshaped metal plate with the forming roller to determine the angle $\beta$ in computing the wall thickness.

5. The method according to claim 1 and further comprising the steps of:

displaying graphically the path on a display device; and changing the path, wherein the step of moving includes moving the forming roller in accordance with the changed path.

6. An apparatus for spinning a metal sheet comprising:

a rotatable chuck;

a clamping device for securing a metal sheet to the chuck;

a forming roller movable relative to the chuck for engaging the metal sheet;

memory means for storing a shape of the chuck as a series of successive points; and a control unit operably connected to the memory means for accessing the stored shape and for providing control signals to the forming roller, the control unit including calculating means for calculating a path of the forming roller, said path comprising a plurality of calculated points wherein each calculated point is calculated by determining a tangent line of the stored shape at each point and adding a desired wall thickness according to a line perpendicular to said tangent line to each associated point of the stored shape.

7. The apparatus of claim 6 wherein the control unit provides control signals to the forming roller to trace the chuck to obtain the series of successive points.

8. The apparatus of claim 7 wherein the calculating means calculates each calculated point by projecting a radius of the forming roller on the stored shape at each point of the traced chuck shape and finding a greatest distance between a surface of the forming roller corresponding to the projecting radius and the traced chuck shape, wherein each point of the stored shape is then the greater distance between the surface of the forming roller corresponding to the projecting radius and the stored shape.

9. The apparatus of claim 6 and further comprising:

display means for displaying the path graphically; and means for changing the path.

* * * * *